US009035856B2

(12) United States Patent
Oh

(10) Patent No.: US 9,035,856 B2
(45) Date of Patent: May 19, 2015

(54) ORGANIC LIGHT EMITTING DISPLAY, AND IMAGE MODIFICATION METHOD

(75) Inventor: Eunjung Oh, Yongin-si (KR)

(73) Assignee: SAMSUNG DISPLAY CO., LD., Yongin, Gyeonggi-Do (KR)

( * ) Notice: Subject to any disclaimer, the term of this patent is extended or adjusted under 35 U.S.C. 154(b) by 1785 days.

(21) Appl. No.: 12/078,702

(22) Filed: Apr. 3, 2008

(65) Prior Publication Data

US 2008/0246699 A1 Oct. 9, 2008

(30) Foreign Application Priority Data

Apr. 5, 2007 (KR) ..... 10-2007-0033533

(51) Int. Cl.
*G09G 3/32* (2006.01)
*G09G 3/20* (2006.01)

(52) U.S. Cl.
CPC ..... *G09G 3/3208* (2013.01); *G09G 3/2081* (2013.01); *G09G 2360/16* (2013.01)

(58) Field of Classification Search
USPC ..... 345/82, 76–78
See application file for complete search history.

(56) References Cited

U.S. PATENT DOCUMENTS

| | | | | |
|---|---|---|---|---|
| 2003/0218583 | A1* | 11/2003 | Hasagawa | 345/76 |
| 2004/0105598 | A1* | 6/2004 | Kondo et al. | 382/307 |
| 2005/0231449 | A1 | 10/2005 | Miyagawa | |
| 2006/0262109 | A1 | 11/2006 | Park et al. | |
| 2007/0279337 | A1* | 12/2007 | Kim et al. | 345/76 |

FOREIGN PATENT DOCUMENTS

| | | | |
|---|---|---|---|
| JP | 2003-228331 | A | 8/2003 |
| JP | 2004-354762 | A | 12/2004 |
| JP | 2005-301095 | | 10/2005 |
| KR | 10-2006-0112998 | A | 11/2006 |
| WO | WO 03/091979 | A1 | 11/2003 |
| WO | WO 2005/006291 | A1 | 1/2005 |

* cited by examiner

*Primary Examiner* — William Boddie
*Assistant Examiner* — Leonid Shapiro
(74) *Attorney, Agent, or Firm* — Lee & Morse, P.C.

(57) ABSTRACT

An organic light emitting display, and an image modification method may include an analog to digital image signal processor configured to output present digital image data, a frame data analysis unit electrically coupled to the image signal processor, the frame data analysis unit configured to receive the present digital image data and a present data summation value, and to output a new data summation value, a light emission time supply unit electrically coupled to the frame data analysis unit and configured to supply a light emission time in accordance with the new data summation value, and a light emission control driver electrically coupled to the light emission time supply unit and configured to output a light emission signal in accordance with the light emission time output from the light emission time supply unit.

17 Claims, 8 Drawing Sheets

ORGANIC LIGHT EMITTING DISPLAY, AND IMAGE MODIFICATION METHOD

BACKGROUND OF THE INVENTION

1. Field of the Invention

Embodiments relate to an organic light emitting display, and an image modification method. More particularly, embodiments relate to an organic light emitting display, and an image modification method that can reduce or eliminate an error of a light emission drive time.

2. Description of the Related Art

A conventional organic light emitting display is a display based upon a principle of selectively emitting light by electrically exciting a fluorescent or phosphorescent compound in organic light emitting diodes (OLEDs). Conventional organic light emitting displays include OLEDs arranged in an n×m matrix.

Each OLED may include a transparent anode, e.g., an indium titanium oxide (ITO) anode, an organic thin-film, and a cathode, e.g., metal. The organic thin-film may be a multi-layer structure, including a light emission layer EML that emits light by coupling an electron with a hole, an electron transport layer ETL that transports an electron, and a hole transport layer HTL that transports a hole. Furthermore, the organic thin-film may include an electron injecting layer EIL that injects a separate electron and a hole injecting layer HIL that injects a hole.

Methods of driving such OLEDs include a passive matrix (PM) method and a metal oxide silicon (MOS) thin-film transistor (TFT) active matrix (AM) method. When using the PM method, lines of anodes and cathodes intersect perpendicularly, and the OLEDS are driven by selecting lines. In contrast, when using the AM method, a TFT and a capacitor are connected to each pixel anode, and the OLEDs are individually driven by maintaining a voltage due to the capacitor capacitance. AM methods include a voltage programming method and a current programming method, depending on the type of signal applied from a data driver.

Depending on image data to be transferred to the OLEDs, driving methods may be divided into an analog drive method and a digital drive method. In the analog drive method, current or voltage corresponding to image data being supplied to an OLED is modulated by a pulse amplitude modulation (PAM) process, with the brightness of the OLED corresponding thereto. In the digital drive method, an amplitude of a current or voltage drive waveform corresponding to image data being supplied to an OLED is modulated by a pulse width modulation (PWM) process, with the brightness of the OLED corresponding thereto.

According to a digital drive method of driving an organic light emitting display, one frame (or field) may be divided into a plurality of sub-frames (or sub-fields). Each sub-frame may include a data write period and a light emission drive period. During the data write period, enable signals may be simultaneously applied to scan lines. During the light emission drive period, an n-bit gray scale may be expressed by drive time of $2^n$ (n=0, 1, 2, . . . , and n−1). For example, if n=4, image data may be between $(0000_{(2)})$ to $15(1111_{(2)})$. Here, image data corresponding to the maximum light emission drive time may be $15(1111_{(2)})$, and may generate a maximum pulse width for which the OLED expresses maximum brightness. If image data is $7(0111_{(2)})$, a pulse width is half of the maximum light emission control drive time and thus, the brightness is lowered. Thus, 4-bit image data may generate 16 pulse widths, which in turn, express 16 gray scales.

In order to reduce power consumption, the brightness of the entire screen may be reduced using an automatic current limit (ALC), in which an amount of current is controlled when the entire screen is lit with a high brightness by an image signal of one frame. The ALC method determines an average brightness value of an organic light emitting display panel by summing up the total data values for displaying on the organic light emitting display panel. A light emission time may be supplied equally to the organic light emitting display panel during one frame in accordance with an average brightness value. However, because each pixel circuit of the organic light emitting display panel has the same light emission drive time irrespective of a data value of each pixel circuit, an erroneous light emission drive time of each pixel circuit may occur.

SUMMARY OF THE INVENTION

Embodiments of the present invention are therefore directed to an organic light emitting display panel, and an image modification method, which substantially overcome one or more of the problems due to the limitations and disadvantages of the related art.

It is therefore a feature of an embodiment of the present invention to provide an organic light emitting display panel, and an image modification method that, when applying data to each pixel circuit, may reduce or eliminate an error of a light emission drive time.

It is therefore another feature of an embodiment of the present invention to provide an organic light emitting display panel, and an image modification method that may quickly process data by turning off a function of controlling a light emission time for each pixel circuit.

At least one of the above and other features and advantages of embodiments may be realized by providing an organic light emitting display including an image signal processor configured to receive a analog image data, and to output present digital image data, a frame data analysis unit electrically coupled to the image signal processor, the frame data analysis unit configured to receive the present digital image data and a present data summation value, and to output a new data summation value, a light emission time supply unit electrically coupled to the frame data analysis unit, and configured to output a light emission time in accordance with the new data summation value, a light emission control driver electrically coupled to the light emission time supply unit and configured to output a light emission signal in accordance with the light emission time output from the light emission time supply unit, and an organic light emitting display panel electrically coupled to the light emission control driver, and configured to emit light in accordance with the light emission signal output from the light emission control driver.

The frame data analysis unit may be supplied with an enable signal, and may be configured to output the digital image data when a frame memory of the frame data analysis unit is turn on and output data summation value when the frame memory of the frame data analysis unit is turn off.

The frame data analysis unit may include a frame memory configured to store the present digital image data from the image signal processor and output a previous digital image data, a comparison unit electrically coupled to the frame memory, and configured to output a difference value between the present digital image data and the previous digital image data from the frame memory, and an addition unit supplied with the difference value and the present data summation value, and configured to output a new data summation value.

The frame memory may be electrically coupled between the image signal processor and the comparator unit, and may be configured to store present digital image data from the image signal processor and output previous digital image data stored in the frame memory to the comparator unit.

The frame memory may be configured to output previous digital image data stored for each sub-frame and store present digital image data from the image signal processor.

The frame memory may be configured to store digital image data of one frame.

The comparison unit may be electrically coupled between the image signal processor and the frame memory, and may be configured to compare the present digital image data from the image signal processor with the previous digital image data from the frame memory.

The addition unit may be electrically coupled to the comparison unit, and may be configured to output a new data summation value by summing up the difference value and a data summation value by summing the present digital image data.

The frame data analysis unit may include a frame memory configured to store a present data summation value by summing the present digital image data and output a previous data summation value, a comparison unit electrically coupled to the frame memory and configured to output a difference value between the previous data summation value and the present data summation value, and an addition unit supplied with the difference value and the present data summation value and configured to output a new data summation value.

The organic light emitting display may further include a data summation unit electrically coupled between the image signal processor and the frame data analysis unit, and configured to output the present data summation value by summing digital image data from the image signal processor.

The frame memory may be electrically coupled between the data summation unit and the comparison unit, and may be configured to store the present data summation value from the data summation unit and output the previous data summation value stored in the frame memory to the comparison unit.

The frame memory may be configured to output the previous data summation value stored for each sub-frame and may store the present data summation value from the data summation.

The comparison unit may be electrically coupled between the frame memory and the addition unit, and may be configured to compare the present data summation value from the addition unit with previous data summation value from the frame memory.

The addition unit may be electrically coupled between the data summation unit and the comparison unit, and may be configured to output the new data summation value by summing up the difference value and the present data summation value.

The organic light emitting display may further include a clock signal supply unit electrically coupled to the image processor, and configured to receive the synchronization signal from image signal processor and output a clock signal and the synchronization signal to the signal light emission control driver.

The organic light emitting display may further include a scan driver electrically coupled between the clock signal supply unit and the organic light emitting display panel, and configured to receive the clock signal and the synchronization signal from the clock signal supply unit and to output a scan signal to the organic light emitting display panel.

The organic light emitting display may further include a data driver electrically coupled between the clock signal supply unit and the organic light emitting display panel, and configured to receive the clock signal and the synchronization signal from the clock signal supply unit and to output the present digital image data from the image signal processor to the organic light emitting display panel.

The light emission control driver may be electrically coupled between the clock signal supply unit and the organic light emitting display panel, and may be configured to receive the clock signal and the synchronization signal from the clock signal supply unit and to output the light emission signal to the organic light emitting display panel.

The organic light emitting display may further include a data summation unit electrically coupled between the image signal processor and the frame data analysis unit, and configured to output the present data summation value by summing digital image data from the image signal processor.

The organic light emitting display may further include a reference value electrically coupled to the light emission time supply unit, and configured to store a light emission time corresponding to the new data summation value.

At least one of the above and other features and advantages of embodiments may be realized by providing an image modification method for an organic light emitting display the method including, converting analog image data into present digital image data, summing the present digital image data and outputting a present data summation value, outputting a previous digital image data stored in a frame memory and storing the present digital image data in the frame memory, comparing the previous digital image data with the present digital image data and outputting a difference value, adding the difference value and the present data summation value output and outputting a new data summation value, and determining a light emission time in accordance with the new data summation value and supplying the light mission time to a light emission control driver.

The converting may be supplied with the analogue image data and may apply the digital image data to the summing and the outputting.

The outputting and the comparing may be carried out during the same period as the summing.

The outputting may include storing the applied digital image data in the frame memory, and bring the previous digital image data stored in the frame memory.

The previous digital image data may be a digital image data which may be stored in the frame memory in a previous frame.

The outputting may include bring the previous digital image data stored in the frame memory and storing the applied digital image data in the frame memory.

The outputting may be to store the digital image data for each sub-frame and output the stored previous digital image data to transfer to the comparing.

The comparing may be to compare the digital image data transferred from the converting with the previous digital image data transferred from the step of outputting, and output a difference value between the digital image data and the previous digital image data.

The summing may be to sum up the digital image data transferred from the converting and output a data summation value.

The adding may be to sum up the difference value transferred from the comparing and the data summation value transferred from the summing and output a new data summation value.

The controlling is to determine a light emission time corresponding to the new data summation value through a reference value in which a light emission time corresponding to the new data summation value is stored.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
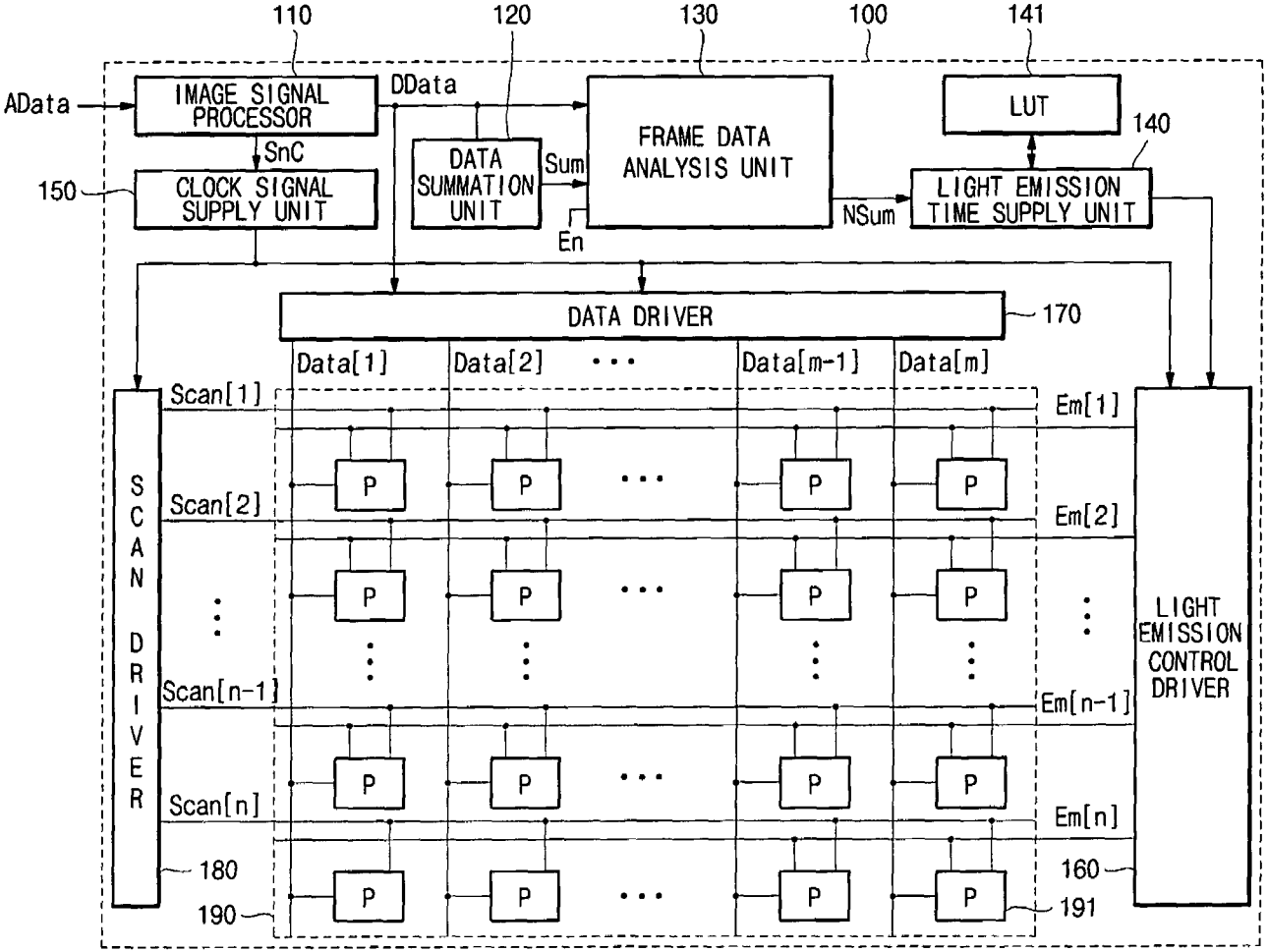
FIG. 1 illustrates a block diagram of an organic light emitting display according to an embodiment of the present invention.

Korean Patent Application No. 10-2007-0033533, filed on Apr. 5, 2007, in the Korean Intellectual Property Office, and entitled: "Organic Light Emitting Display and Image Modification Method," is incorporated by reference herein in its entirety.

Embodiments will now be described more fully hereinafter with reference to the accompanying drawings. Embodiments may, however, be embodied in different forms and should not be construed as limited to the embodiments set forth herein. Rather, these embodiments are provided so that this disclosure will be thorough and complete, and will fully convey the scope of the invention to those skilled in the art.

Here, elements having similar constitutions and operations are denoted by the same reference numeral. Furthermore, it should be understood that electrical coupling between a certain element and another element includes direct electrical coupling between them, as well as indirect electrical coupling between them by an interposed element.

FIG. 1 illustrates a block diagram of an organic light emitting display according to an embodiment of the present invention.

As shown in FIG. 1, an organic light emitting display may include an image signal processor 110, a data summation unit 120, a frame data analysis unit 130, a light emission time supply unit 140, a clock signal supply unit 150, a light emission control driver 160, a data driver 170, a scan driver 180, and an organic light emitting display panel 190.

The image signal processor 110 may sample an analog image data (AData) supplied from the outside, and may separate a synchronization signal (SnC) and a digital image data (DData) having a predetermined number of bits from the sampled data. The image signal processor 110 may supply the digital image data (DData) to the data summation unit 120, the frame data analysis unit 130, and the data driver 170, and may supply the synchronization signal (SnC) to the light emission driver 160, the data driver 170, and the scan driver 180.

The data summation unit 120 may sum up the digital image data (DData) from the image signal processor 110 and output a data summation value (Sum). The data summation value (Sum) may be a value produced by summing up all digital image data (DData) during one frame, e.g., all digital image data (DData) supplied to respective pixel circuits 191 of the organic light emitting display panel 190 during one frame. The data summation value (Sum) may be supplied to the frame data analysis unit 130.

The frame data analysis unit 130 may receive the digital image data (DData) from the image signal processor 110 and the data summation value (Sum) from the data summation unit 120, and may output a new data summation value (NSum). The frame data analysis unit 130 may also be supplied with an enable signal (En), and may be turned on and off. When the enable signal (En) is applied, i.e. the frame data analysis unit 130 is turned on, the frame data analysis unit 130 may output a new data summation value (NSum). When an enable bar signal (EnB) is applied, i.e., the frame data analysis unit 130 is turned off, the data summation value (Sum) applied from the data summation unit 120 may be output as the new data summation value (NSum).

When turned off, the frame data analysis unit 130 may quickly apply a data and a light emission time for a frame to the organic light emitting display panel 190, reducing driving time. When turned on, the frame data analysis unit 130 may apply a new data summation value (NSum) for each sub-frame, reducing light emission drive time error. The structure and operation method of the frame data analysis unit 130 will be described in detail with reference to FIGS. 2 to 5.

The light emission time supply unit 140 may be electrically coupled to a reference value look-up table (LUT) 114, and may supply a light emission time corresponding to the new data summation value (NSum) applied from the frame data analysis unit 130 to the light emission control driver 160. The reference value LUT 141 may include a memory storing a light emission time corresponding to the new data summation value (NSum).

The clock signal supply unit 150 may receive the synchronization signal (SnC) from the image signal processor 110, and supply a clock signal and a synchronization signal to the light emission control driver 160, the data driver 170, and the scan driver 180. The synchronization signal (SnC) is a signal that simultaneously informs the light emission control driver 160, the data driver 170, and the scan driver 180 of the commencement of one frame. The clock signal is a signal that simultaneously informs the light emission control driver 160, the data driver 170, and the scan driver 180 of the commencement of one sub-frame.

The light emission control driver 160 may supply the light emission time from the light emission time supply unit 140 to respective pixel circuits 191. Each pixel circuit 191 may operate by being supplied with the digital image data (DData) from a data line (Data[i], where $1 \le i \le m$) and a light emission control signal (a light emission time) from the light emission driver 160 through a light emission control line (Em[j], where $1 \le j \le n$). The light emission control driver 160 may supply a light emission time to one pixel circuit 191 for every one sub-frame. Since the light emission control driver 160 supplies a light emission time to each pixel circuit 191 by comparing digital image data (DData) applied to each pixel circuit 191 with previous digital image data applied to each pixel circuit 191 in a previous frame and analyzing a light emission time in the frame data analysis unit 130 in accordance with a difference value between them, errors in light emission time supplied to a pixel circuit may be reduced or eliminated.

The data driver 170 may supply the digital image data (DData) to the panel through the plurality of data lines (Data[1], Data[2], . . . , and Data[m]). The data driver 170 may sequentially shift the digital image data (DData) supplied from the image signal processor 110 and maintain one column of digital image data (DData). Thereafter, the data driver 170 may latch the one column of digital image data (DData) that is maintained, produce a data signal corresponding to a gray value of each digital image data (DData), and supply it to a data line (Data[i]) at a predetermined time.

The scan driver 180 may sequentially supply the scan signal to the organic light emitting display panel 190 through a plurality of scan lines (Scan[1], Scan[2], . . . , and Scan[n]). The scan driver 180 may apply a sequential scan signal to the scan lines (Scan[1], Scan[2], . . . , and Scan[n]) using the synchronization signal (SnC) and the clock signal supplied from the clock signal supply unit 150.

The organic light emitting display panel 190 may include the plurality of scan lines (Scan[1], Scan[2], . . . , and Scan [n]) and the plurality of light emission control lines (Em[1], Em[2], . . . , and Em[n]) arranged in a first direction, e.g., a row direction, the plurality of data lines (Data[1], Data[2], . . . , and Data[m]) arranged in a second direction, e.g., a column direction, and the pixel circuits 191 respectively defined by the scan lines (Scan[1], Scan[2], . . . , and Scan [n]), the data lines (Data[1], Data[2], . . . , and Data[m]) and the light emission control lines (Em[1], Em[2], . . . , and Em[n]).

Each pixel circuit 191 may be formed in a pixel area defined by two adjacent scan lines (or light emission control lines) and two adjacent data lines. Namely, n×m pixel circuits 191 may be formed on the pixel area. As described above, the light emission control lines (Em[1], Em[2], . . . , and Em[n]) may be supplied with a light emission control signal from the light emission control driver 160, and the data lines (Data[1], Data[2], . . . , and Data[m]) may be supplied with a data signal from the data driver 170, and the scan lines (Scan[1], Scan[2], . . . , and Scan [n]) may be supplied with a scan signal from the scan driver 180.

Figure 2:
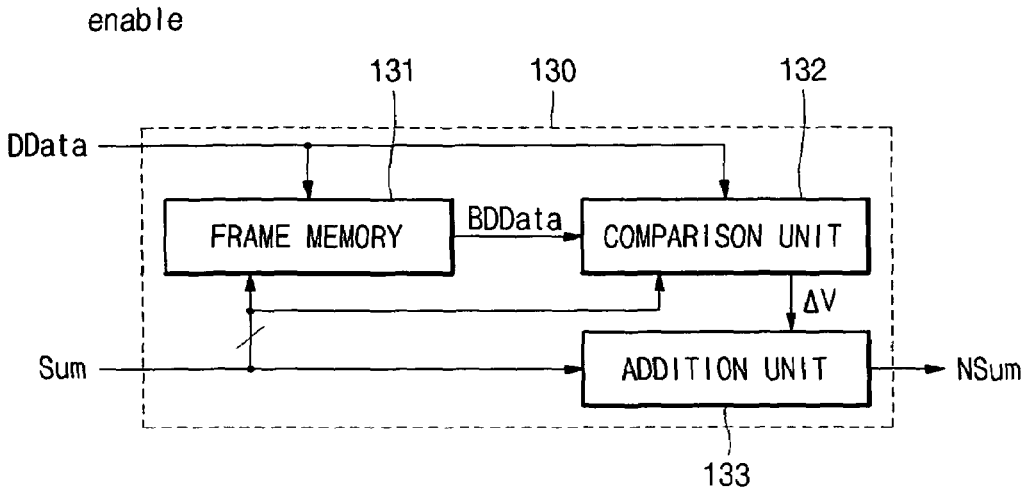
FIG. 2 illustrates a block diagram of an operation of the frame data analysis unit of the organic light emitting display of FIG. 1 when an enable signal is applied, in accordance with an embodiment.

FIG. 2 illustrates a block diagram of an operation of the frame data analysis unit 130 of the organic light emitting display 100 of FIG. 1 when an enable signal is applied according to an embodiment.

As shown in FIG. 2, the frame data analysis unit 130 may include a frame memory 131, a comparison unit 132, and an addition unit 133. As shown in FIG. 2, when the enable signal is applied to the frame analysis unit 130 of FIG. 2, the data summation value (Sum) is not applied to the frame memory 131 and the comparison unit 132, but is applied to the addition unit 133.

The frame memory 131 may store the digital image data (DData) applied thereto and output a previous digital image data (BDData) stored in a previous sub-frame. The frame memory 131 may read a digital image data once for one sub-frame and store a new digital image data. The stored digital image data (DData) may be supplied to the pixel circuit 191 of the panel through the data driver 170, and the digital image data (DData) stored in the frame memory 131 and the output previous digital image data (BDData) may be supplied to the same pixel circuit 191. For example, if the previous digital image data (BDData) is supplied to n×m pixel circuits 191 in the previous frame, then the digital image data (DData) is supplied to n×m pixel circuits 191 in the next frame. The frame memory 131 may store n×m digital image data (DData) to corresponding pixel circuits 191 in one frame and output the same. Further, one frame may include n×m sub-frames.

The comparison unit 132 may compare the digital image data (DData) from the image signal processor 110 with the previous digital image data (BDData) from the frame memory 131 and output a difference value (ΔV) between the two digital image data. The comparison unit 132 may output the difference value (ΔV) by subtracting the previous digital image data (BDData) from the digital image data (DData). The comparison unit 132 may operate every time the previous digital image data (BDData) is applied from the frame memory 131.

The addition unit 133 may add the data summation value (Sum) applied from the data summation unit 120 and the difference value (ΔV) applied from the comparison unit 132, and output a new summation value (NSum). The addition unit 133 may operate every time the difference value (ΔV) is applied from the comparison unit 132. That is, the addition unit 133 may output a new data summation value once for one sub-frame and supply it to the light emission time supply unit 140.

The light emission time supply unit 140 may supply a light emission time corresponding to a new summation value (NSum) once for one sub-frame. That is, because the light emission time supply unit can supply a light emission time corresponding to the digital image data (DData) of each pixel circuit 191 to the light emission control driver 160, a light emission time having reduced or no error may be supplied to the light emission control driver 160.

Figure 3:
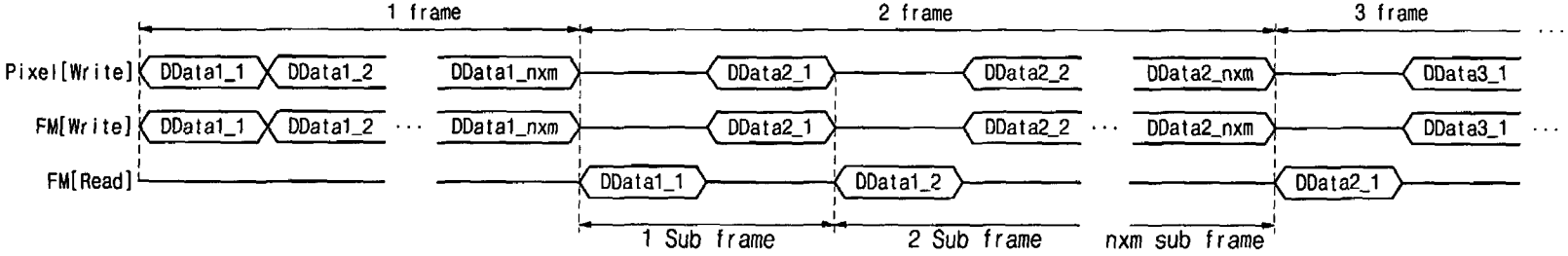
FIG. 3 illustrates a timing diagram of the frame data analysis unit of FIG. 2.

FIG. 3 illustrates a drive timing diagram of the frame data analysis unit of FIG. 2. Hereinafter, the driving of the organic light emitting display 100 of FIG. 1 will be described with reference to FIG. 3.

As shown in FIG. 3, the drive timing diagram of the frame data analysis unit 130 may include a first frame (1 frame) and a second frame (2 frame), a third frame (3 frame), and so forth. Frames after the second frame (2 frame) may operate in the same manner as the second frame (2 frame). Hereinafter, the drive timing diagram will be described in conjunction with digital image data (Pixel[Write]) stored in the pixel circuit 191, digital image data (FM[Write]) stored in the frame memory 131, and digital image data (FM[Read]) output from the frame memory 131. Here, the digital image data (Pixel[Write]] stored in the pixel circuit 191 and the digital image data (FM[Write]) stored in the frame memory 131 are the same digital image data (DData).

Analog image data (AData1) of the first frame (1 frame) may be applied to the image signal processor 110, so that the first frame (1 frame) produces digital image data (DData1_1 to DData1_*n*×*m*) of the first frame (1 frame). The digital image data (DData1_1 to DData1_*n*×*m*) of the first frame (1 frame) applied to the frame data analysis unit 130 may be stored in the frame memory 131. Since the first frame is the initial frame, i.e., there is no previous digital image data stored in the frame memory 131, the comparison unit 132 and the addition unit 133 are not operated. Further, at this time, the digital image data (DData1_1 to DData1_*n*×*m*) of the first frame (1 frame) are applied to the data driver 170 of the organic light emitting display 100. The data driver 170 applies the digital image data (DData1_1 to DData1_*n*×*m*) during the first frame (1 frame) to the pixel circuits 191, which in turn, emit light for a data period corresponding to the digital image data (DData1_1 to DData1_*n*×*m*).

Analog image data (AData) of the second frame may be applied to the image signal processor 110, so that the second frame (2 frame) produces digital image data (DData2_1 to DData2_n×m) of the second frame (2 frame). At this time, the digital image data (DData2_1 to DData2_n×m) of the second frame (2 frame) applied to the frame data analysis unit 130 may be stored in the frame memory 131. Here, a first sub-frame (1 sub-frame) is a period that stores a $2_1^{th}$ digital image data (DData2_1) in the frame memory 131 and outputs a $1_1^{th}$ digital image data (DData1_1) stored in the frame memory 131 in a previous frame. At this time, the comparison unit 132 is supplied with the $2_1^{th}$ digital image data (DData2_1) and the $1_1^{th}$ digital image data (DData1_1), and outputs a difference value (ΔV) between two digital image data. For example, the comparison unit 132 may output a difference value (ΔV) by subtracting the $1_1^{th}$ digital image data (DData1_1) from the $2_1^{th}$ digital image data (DData2_1). The addition unit 133 that is supplied with the difference value (ΔV) produces a new summation value (NSum) by adding the data summation value (Sum) from the data summation unit 120 and the difference value (ΔV) from the comparison unit 132. The second sub-frame (2 sub-frame) to $n\times m^{th}$ sub-frame (n×m sub-frame) operates in the same manner as the first sub-frame (1 sub-frame). When the digital image data (DData2_1 to DData2_n×m) during the second frame (2 frame) is applied to the pixel circuits 191, the pixel circuits 191 emit light for a data period corresponding to the digital image data (DData2_1 to DData2_n×m). For example, by applying a light emission time corresponding to the new summation value (NSum) output by the addition unit 133 to the light emission control driver 160 while the data image date (DData2_1 to DData2_n×m) is applied to the data driver, an OLED of the pixel circuit 191 emits light.

Figure 4:
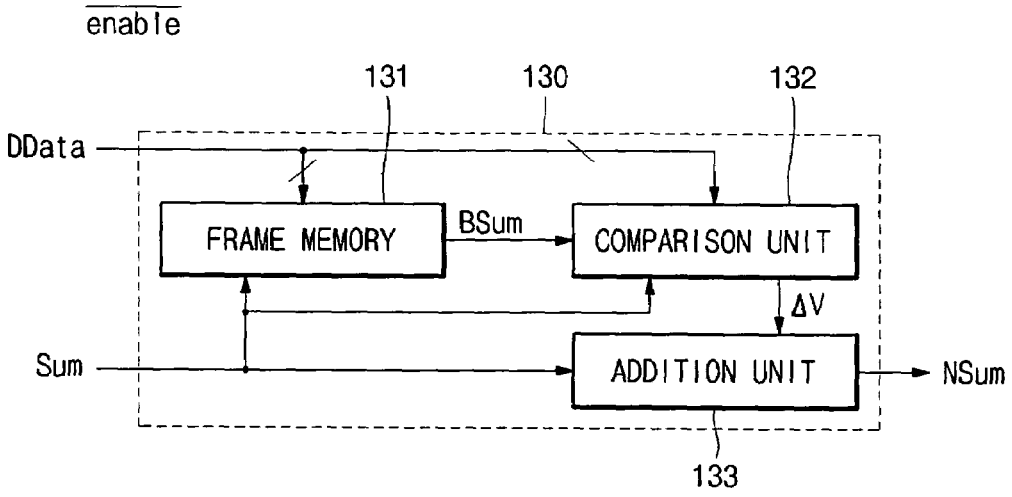
FIG. 4 illustrates a block diagram an operation of the frame data analysis unit of the organic light emitting display of FIG. 1 when an enable bar signal is applied.

FIG. 4 illustrates a block diagram of an operation of the frame data analysis unit 130 of the organic light emitting display 100 of FIG. 1 when an enable bar signal is applied according to an embodiment.

As shown in FIG. 4, the frame data analysis unit 130 of the organic light emitting display 100 may include the frame memory 131, the comparison unit 132 and the addition unit 133. When the enable bar signal is applied to the frame analysis unit 130 of FIG. 4, the digital image data (DData) is not applied to the frame memory 131 and the comparison unit 132, as when the enable signal is applied, as shown in FIG. 2.

In contrast, when the enable bar signal is applied, the frame memory 131 may store the data summation value (Sum) applied thereto and output a previous data summation value (BSum) stored in a previous frame. The frame memory 131 may read a data summation value once for one frame and stores a new data summation value. At this time, the stored data summation value (Sum) is applied to the frame memory 131 through the data summation unit 120. The digital image data (DData) is supplied to the pixel circuit 191 of the panel 190 through the data driver 170, and the digital image data (DData), i.e., n×m digital image data (DData) having the same number as the pixel circuits 191 in one frame, may be supplied to the pixel circuits 191.

The comparison unit 132 may compare the previous data summation value (BSum) from the frame memory 131 with the data summation value (Sum) applied from the data summation unit 120 and output a difference value (ΔV). For example, the comparison unit 132 may output the difference value (ΔV) by subtracting the previous data summation value (BSum) from the data summation value (Sum). The comparison unit 132 may operate every time the previous data summation value (BSum) is applied from the frame memory 131. For example, the comparison unit 132 may output the difference value (ΔV) once for each frame.

The addition unit 133 may add the data summation value (Sum) from the data summation unit 120 and the difference value (ΔV) from the comparison unit 132, and may output a new summation value (NSum). The addition unit 133 may operate every time when the difference value (ΔV) is applied from the comparison unit 132. For example, the addition unit 133 may output a new data summation value (NSum) once for one frame and supply it to the light emission time supply unit 140. The light emission time supply unit 140 may supply a light emission time corresponding to the new summation value (NSum) to the light emission control driver 160 during one frame.

Figure 5:
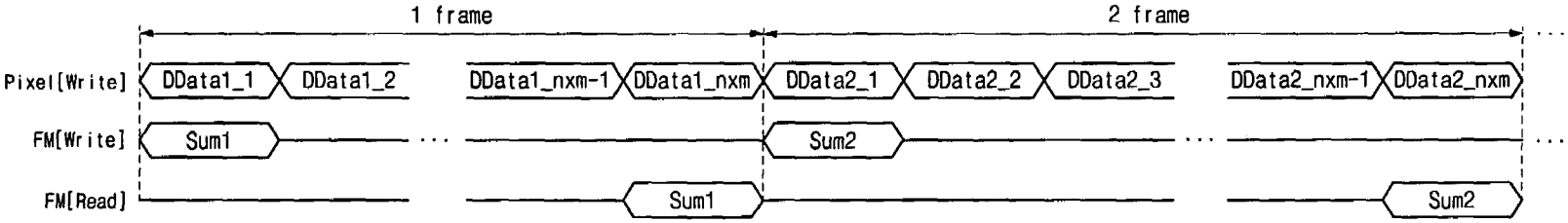
FIG. 5 illustrates a timing diagram of the frame data analysis unit of FIG. 4.

FIG. 5 illustrates a drive timing diagram of the frame data analysis unit 130 of FIG. 4. Hereinafter, the driving of the organic light emitting display 100 of FIG. 1 will be described with reference to FIG. 5.

As shown in FIG. 5, the drive timing diagram of the frame data analysis unit 130 may include a first frame (1 frame), a second frame (2 frame), and so forth. Frames after the second frame (2 frame) are operated equally to the second frame (2 frame). Hereinafter, the drive timing diagram will be described in conjunction with a digital image data (Pixel [Write]) stored in the pixel circuit 191, a data summation value (FM[Write]) stored in the frame memory 131 and a previous data summation value (FM[Read]) output from the frame memory 131. Here, the previous data summation value (FM[Read]) is a data summation value that is stored in the frame memory 131 in the previous frame.

Analog image data (AData) of the first frame may be applied to the image signal processor 110, so that the first frame (1 frame) produces digital image data (DData1_1 to DData1_n×m) of the first frame. The digital image data (DData1_1 to DData1_n×m) of the first frame may be applied to the data summation unit 120, which outputs a first data summation value (Sum1). The first data summation value (Sum1) may be applied to the frame data analysis unit 130. The first data summation value (Sum1) applied to the frame data analysis unit 130 may be stored in the frame memory 131. Here, because the first frame (1 frame) is the initial frame and thus, there is no previous digital image data stored in the frame memory 131, the comparison unit 132 and the addition unit 133 are not operated. Further, the digital image data (DData1_1 to DData1_n×m) of the first frame are applied to the data driver 170 of the organic light emitting display 100. The data driver 170 applies the digital image data (DData1_1 to DData1_n×m) during the first frame (1 frame) to the pixel circuit 191, and the pixel circuit 191 emits light for a data period corresponding to the digital image data (DData1_1 to DData1_n×m).

An analog image data (AData) of the second frame is applied to the image signal processor 110, so that the second frame (2 frame) produces digital image data (DData2_1 to DData2_n×m) of the second frame. At this time, the digital image data (DData2_1 to DData2_n×m) of the second frame are applied to the data summation unit 120 and output a second data summation value (Sum2), and the second data summation value (Sum2) is applied to the frame data analysis unit 130. Furthermore, the second data summation value (Sum2) applied to the frame data analysis unit 130 is stored in the frame memory 131. Before the second data summation value (Sum2) is stored in the frame memory 131, the first data summation value (Sum1) stored in the frame memory 131 in the first frame is output. At this time, the comparison unit 132 is supplied with the first data summation value (Sum1) and the second data summation value (Sum2), compares the two data summation values and produces a difference value (ΔV). For example, the comparison unit may output a difference value (ΔV) by subtracting the first data summation value (Sum1) from the second data summation value (Sum2). The addition unit 133 supplied with the difference value (ΔV) may produce a new summation value by adding the second data summation value (Sum2) from the data summation unit 120 and the difference value (ΔV) from the comparison unit 132.

According to the timing diagram of FIG. 5, a time (FM [Read]) for reading and outputting the data value stored in the frame memory 131 may reduced. Thus, the drive method may be faster as compared with the drive method illustrated in FIG. 3.

Figure 6:
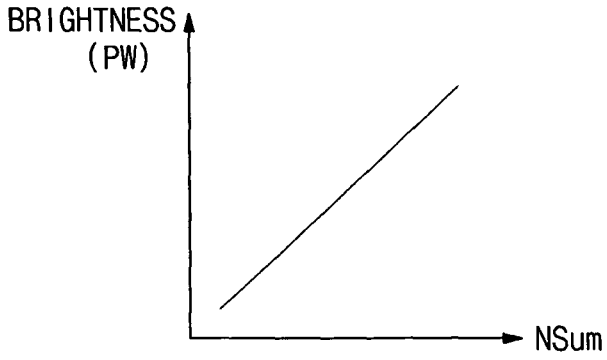
FIG. 6 illustrates a characteristic curve of a reference value of the organic light emitting display of FIG. 1.

FIG. 6 illustrates a relationship between new summation values (NSum) and brightness, represented in units of pulse widths (PW), for the organic light emitting display 100 of FIG. 1. As illustrated therein, the brightness (PW) value may be directly proportional, e.g., linearly proportional, to the new summation value (NSum). For example, if the new summation value (NSum) increases in comparison with the previous new summation value (NSum), a pulse width (PW) of a light emission signal of the light emission control driver 160 may be correspondingly increased. As the pulse width (PW) of the light emission increases, a brightness of the OLED may increase.

Figure 7:
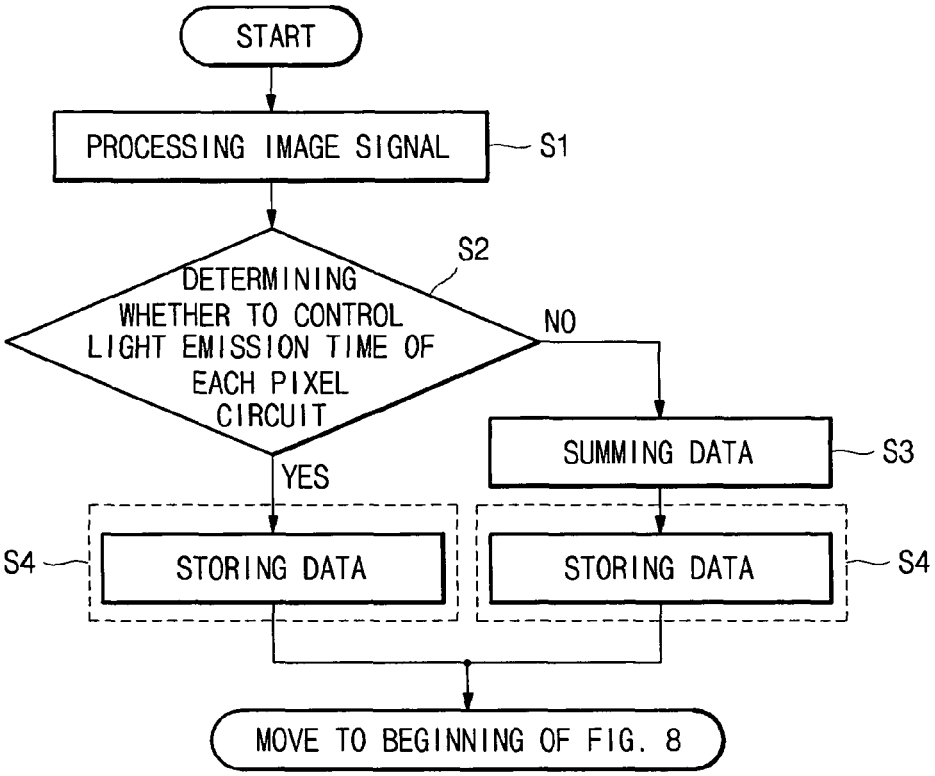
FIG. 7 illustrates a flow chart of an image modification method of an organic light emitting display of a first frame according to an embodiment.

FIG. 7 illustrates a flow chart of an image modification method of the organic light emitting display 100 for a first frame according to an embodiment.

As shown in FIG. 7, the flow chart for the first frame (hereinafter, referred to as "the first frame") of an image modification method may include a processing image signal operation S1, a first decision operation S2, a summing operation S3, and storing operation S4.

During the processing image signal operation S1, analog image data (AData) supplied from the outside is sampled, and synchronization data (SnC) and digital image data (DData) may be separated from the sampled data.

The first decision operation S2 determines whether or not light emission time for each pixel circuit is to be controlled. When the light emission time is to be controlled for each pixel, i.e., YES, the flow may proceed to the storing operation S4, e.g., each sub-frame may have a separately controlled light emission time.

When the light emission time is not to be controlled for each pixel, i.e., NO, e.g., when light emission time of all pixels is to be equalized in one frame, the flow may proceed to the summing operation S3. When the answer to the first decision operation S2 is NO, the frame data analysis unit 130 may operate once for one frame or may operate for each sub-frame the number of which is the same as the number (n×m) of each pixel circuit 191 in one frame.

The summing operation S3 may produce a data summation value (Sum) by summing up all digital image data (DData) in one frame. For example, all digital image data (DData) supplied to each pixel circuit 191 of an organic light emitting display panel 190 in one frame may be added.

The storing operation S4 may include storing data and storing data summation value in the frame memory. For example, when the answer to the first decision operation S2 is YES, all digital image data (DData) of the first frame may be stored. When the answer to the first decision operation S2 is NO, the data summation value (Sum) produced during the summing operation S3 may be stored.

Figure 8:
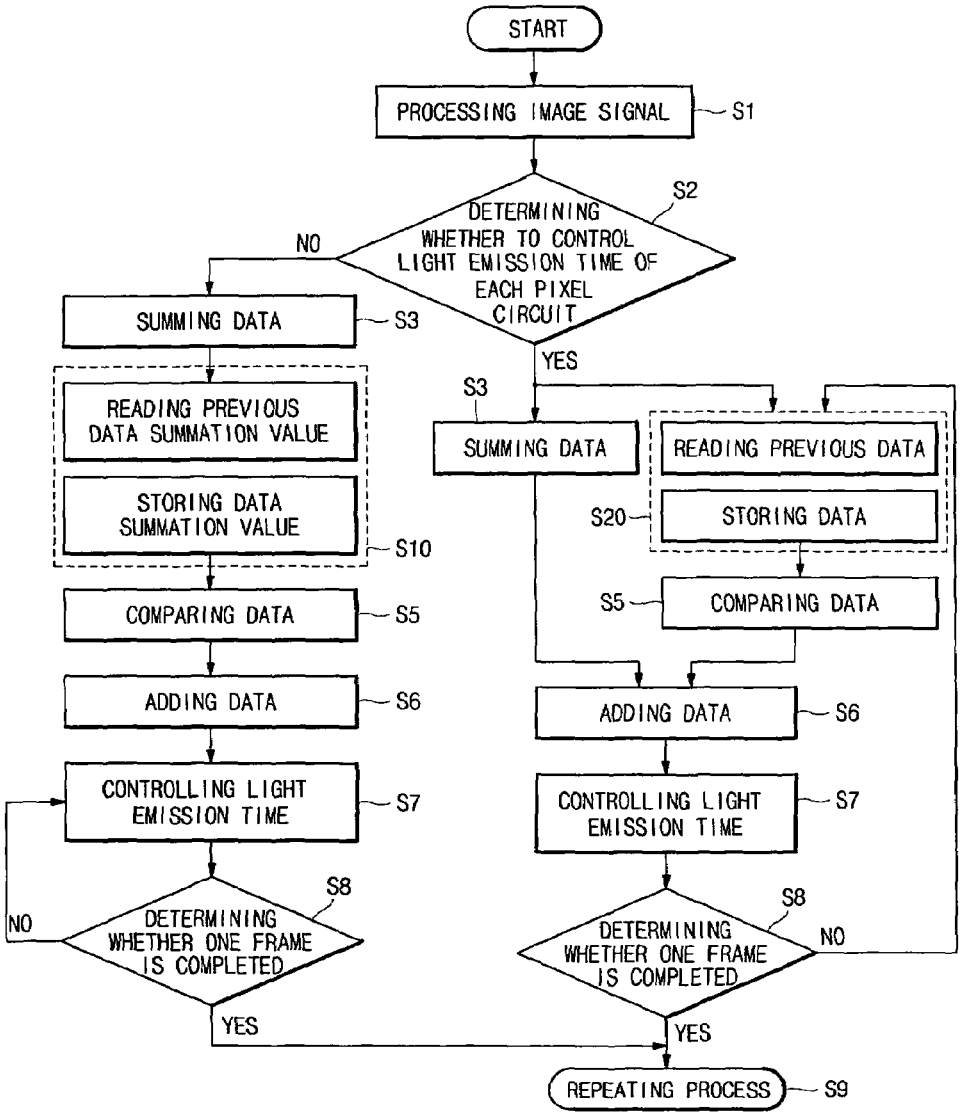
FIG. 8 illustrates a flow chart of an image modification method of an organic light emitting display of subsequent frames according to an embodiment.

When the processing image signal operation S1, the first decision operation S2, the summing operation S3, and the storing operation S4 are completed, the beginning step of FIG. 8 is commenced. Since there is no previous frame for the first frame, there is nothing stored in the frame memory 131. Thus, a comparison operation S5, an adding operation S6, a controlling light emission time operation S7, and a second decision operation S8 of FIG. 8 are not needed. According to an image modification method of an organic light emitting display, after the digital image data (DData) in the first frame is stored as illustrated in FIG. 7, operation of FIG. 8 may be performed for the remaining frames in accordance with an embodiments.

FIG. 8 illustrates a flow chart of an image modification method of an organic light emitting display 100 according to an embodiment of the present invention.

As shown in FIG. 8, an image modification method of an organic light emitting display may include the processing image signal operation S1, the first decision operation S2, the summing operation S3, a reading and storing operation S10, a reading and storing operation S20, the comparison operation S5, the adding operation S6, the controlling light emission time operation S7, the second decision operation S8, and a repeating operation S9. The image modification method illustrated in FIG. 8 is to operate in frames other than the first frame.

During the processing image signal operation S1, analog image data (AData) supplied from the outside is sampled, and synchronization data (SnC) and digital image data (DData) may be separated from the sampled data.

The first decision operation S2 determines whether or not light emission time for each pixel circuit is to be controlled. When the light emission time is to be controlled for each pixel, i.e., YES, the flow may proceed to the storing operation S4, e.g., each sub-frame may have a separately controlled light emission time.

When the light emission time is not to be controlled for each pixel, i.e., NO, e.g., when light emission time of all pixels is to be equalized in one frame, the flow may proceed to the summing operation S3. When the answer to the first decision operation S2 is NO, the frame data analysis unit 130 may operate once for one frame or may operate for each sub-frame the number of which is the same as the number (n×m) of each pixel circuit in one frame.

The summing operation S3 may produce a data summation value (Sum) by summing up all digital image data (DData) in one frame. For example, all digital image data (DData) supplied to each pixel circuit 191 of the organic light emitting display panel 190 in one frame may be added. The summing operation S3 is the same for both YES and NO answers to the first decision operation S2.

When the answer to the first decision operation S2 is YES, the reading and storing operation S20 may read previous digital image data stored in the frame memory 131 for a previous frame and store the digital image data of the present frame in the frame memory 131. At this time, the read digital image data of the previous frame and the digital image data of the present frame are data applied to the same pixel circuit 191 at an interval of one frame. When the answer to the first decision operation S2 is YES, the reading and storing operation S20 may operate for every sub-frame, so as to control a light emission time in accordance with the digital image data applied to each pixel circuit 191.

When the answer to the first decision operation S2 is NO, the reading and storing operation S10 reads a previous data summation value stored in the frame memory 131 in a previous frame and stores the data summation value of the present frame in the frame memory 131. When the answer to the first decision operation S2 is NO, the reading and storing operation S10 may apply the same light emission time to the pixel circuit 191 during one frame, i.e., may operate once for one frame to control a light emission time.

When the answer to the first decision operation S2 is YES, the comparison operation S5 may compare the read previous digital image data with the stored digital image data and output a difference value. For example, the difference value may be obtained by subtracting the digital image data of the previous frame from the digital image data of the present frame. When the answer to the first decision operation S2 is YES, the comparison operation S5 may operate when the reading and storing operation S20 operates.

When the answer to the first decision operation S2 is NO, the comparison operation S5 may compare the read previous data summation value image data with the stored data summation value, and may output a difference value between them. For example, a difference value may be obtained by subtracting the data summation value of the previous frame from the data summation value of the present frame. When the answer to the first decision operation S2 is NO, the comparison operation S5 may operate once for each frame.

When the answer to the first decision operation S2 is YES, the adding operation S6 may add the data summation value from the summing operation S3 and the difference value from the comparison operation S5, and may output a new data summation value (NSum). The adding operation S6 may be performed every time the difference value from the comparison operation S5 is output, i.e., the adding operation S6 may be performed once for each sub-frame.

When the answer to the first decision operation S2 is NO, the adding data operation S6 may add the data summation value (Sum) from the summing operation S3 and the difference value from the comparison operation S5, and may output a new data summation value (NSum). The adding operation S6 may be performed every time the difference value is output from the comparison operation S5, i.e., the adding operation S6 may operate once for each frame.

The controlling light emission time operation S7 may output a light emission time corresponding to a new data summation value from the adding operation S6 for both YES and NO answers to the first decision operation S2. During the controlling light emission time operation S7, if a new data summation value is smaller than a new data summation value of a previous frame, then a light emission time supplied to the pixel circuit 191 is decreasing and, if a new data summation value is larger than a new data summation value of a previous frame, then a light emission time supplied to the pixel circuit 191 is increasing.

After the controlling light emission time operation S7, the flow proceeds to the second decision operation S8. For both answers to the first decision operation S2, if one frame is completed (YES), the flow proceeds from the second decision operation S8 to the repeating operation S9.

If one frame is not completed (NO) and the answer to the first decision operation S2 is YES, the flow proceeds from the second decision operation S8 to the reading and storing operation S20. Thus, the reading and storing operation S20 to the controlling light emission time operation S7 are performed for the next sub-frame, and separately controlled light emission times are supplied to the pixel circuit 191.

If one frame is not completed (NO) and the answer to the first decision operation S2 is NO, the flow proceeds from the second decision operation S8 to the controlling light emission time operation S7. Thus, by returning to the controlling light emission time operation S7, the same light emission time is supplied to the pixel 191 circuit in the next sub-frame.

The repeating process S9 insures that, once for each frame, the processing image signal operation S1 to the second decision operation S8 are performed. Thus, whether to control a light emission time for each pixel circuit 191 or to provide each pixel circuit 191 with the same light emission time may be independently determined for each frame.

As described above, the organic light emitting display, and the image modification method according to embodiments may reduce or eliminate error of a light emission drive time by reading the previous digital image data stored in the frame memory when applying a data to each pixel circuit, directly comparing it with a digital image data to be stored, and determining a light emission drive time in accordance with a difference value.

Further, the organic light emitting display and the image modification method according to embodiments may quickly process data by turning off a function of controlling a light emission time for each pixel circuit, since the function controlling a light emission time for each pixel circuit may be controlled individually for each frame.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

an image signal processor to receive a analog image data, and to output present digital image data;

a data summation unit, the data summation unit to receive the present digital image data, and to output a present data summation value that is the sum of the present digital image data during one frame;

a frame data analysis unit electrically coupled to the data summation unit and the image signal processor, the frame data analysis unit to receive the present digital image data and the present data summation value, and to output a new data summation value;

a light emission time supply unit electrically coupled to a reference value table and the frame data analysis unit, the reference value table including light emission times corresponding to respective new data summation values, and the light emission time supply unit being to output a light emission time in accordance with the new data summation value output by the frame data analysis unit using the reference value table;

a light emission control driver electrically coupled to the light emission time supply unit and to output a light emission signal in accordance with the light emission time output from the light emission time supply unit; and an organic light emitting display panel electrically coupled to the light emission control driver, and to emit light in accordance with the light emission signal output from the light emission control driver, wherein the frame data analysis unit includes:

a frame memory to store the present data summation value, and output a previous data summation value;

a comparison unit electrically coupled to the frame memory, and to output a difference value between the previous data summation value and the present data summation value; and an addition unit supplied with the difference value and the present data summation value, and to output the new data summation value.

2. The organic light emitting display as claimed in claim 1, wherein the frame data analysis unit is supplied with an enable signal, and is to output the digital image data when a frame memory of the frame data analysis unit is turn on and output data summation value when the frame memory of the frame data analysis unit is turn off.

3. The organic light emitting display as claimed in claim 1, wherein the frame memory is electrically coupled between the data summation unit and the comparison unit, and is to store the present data summation value from the data summation unit and output the previous data summation value stored in the frame memory to the comparison unit.

4. The organic light emitting display as claimed in claim 3, wherein the frame memory is to output the previous data summation value stored for each sub-frame and store the present data summation value from the data summation unit.

5. The organic light emitting display as claimed in claim 3, wherein the frame memory is to store data summation value of one frame.

6. The organic light emitting display as claimed in claim 1, wherein the comparison unit is electrically coupled between the frame memory and the addition unit, and is to compare the present data summation value from the addition unit with previous data summation value from the frame memory.

7. The organic light emitting display as claimed in claim 1, wherein the addition unit is electrically coupled between the data summation unit and the comparison unit, and is to output the new data summation value by summing up the difference value and the present data summation value.

8. The organic light emitting display as claimed in claim 1, further comprising a clock signal supply unit electrically coupled to the image processor, and to receive the synchronization signal from image signal processor and output a clock signal and the synchronization signal to the signal light emission control driver.

9. The organic light emitting display as claimed in claim 8, further comprising a scan driver electrically coupled between the clock signal supply unit and the organic light emitting display panel, and to receive the clock signal and the synchronization signal from the clock signal supply unit and to output a scan signal to the organic light emitting display panel.

10. The organic light emitting display as claimed in claim 8, further comprising a data driver electrically coupled between the clock signal supply unit and the organic light emitting display panel, and to receive the clock signal and the synchronization signal from the clock signal supply unit and to output the present digital image data from the image signal processor to the organic light emitting display panel.

11. The organic light emitting display as claimed in claim 8, wherein the light emission control driver is electrically coupled between the clock signal supply unit and the organic light emitting display panel, and is to receive the clock signal and the synchronization signal from the clock signal supply unit and to output the light emission signal to the organic light emitting display panel.

12. An organic light emitting display, comprising:

an image signal processor to receive a analog image data, and to output present digital image data;

a data summation unit, the data summation unit to receive the present digital image data, and to output a present data summation value that is the sum of the present digital image data during one frame;

a frame data analysis unit electrically coupled to the data summation unit and the image signal processor, the frame data analysis unit to receive the present digital image data and the present data summation value, and to output a new data summation value;

a light emission time supply unit electrically coupled to the frame data analysis unit, and to output a light emission time in accordance with the new data summation value;

a light emission control driver electrically coupled to the light emission time supply unit and to output a light emission signal in accordance with the light emission time output from the light emission time supply unit; and an organic light emitting display panel electrically coupled to the light emission control driver, and to emit light in accordance with the light emission signal output from the light emission control driver, wherein the frame data analysis unit includes:

a frame memory to store the present digital image data from the image signal processor and output a previous digital image data;

a comparison unit electrically coupled to the frame memory, and to output a difference value between the present digital image data and the previous digital image data from the frame memory; and an addition unit electrically coupled to the comparison unit and supplied with the difference value and the present data summation value, and to output the new data summation value by summing up the difference value and a data summation value by summing the present digital image data.

13. The organic light emitting display as claimed in claim 12, wherein the frame memory is electrically coupled between the image signal processor and the comparator unit, and is to store present digital image data from the image signal processor and output previous digital image data stored in the frame memory to the comparator unit.

14. The organic light emitting display as claimed in claim 13, wherein the frame memory is to output previous digital image data stored for each sub-frame and store present digital image data from the image signal processor.

15. The organic light emitting display as claimed in claim 13, wherein the frame memory is to store digital image data of one frame.

16. The organic light emitting display as claimed in claim 13, wherein the comparison unit is electrically coupled between the image signal processor and the frame memory, and is to compare the present digital image data from the image signal processor with the previous digital image data from the frame memory.

17. The organic light emitting display as claimed in claim 12, further comprising a reference value table electrically coupled to the light emission time supply unit, and to store a light emission time corresponding to the new data summation value.

* * * * *